US009622308B2

(12) United States Patent
Ido

(10) Patent No.: US 9,622,308 B2
(45) Date of Patent: Apr. 11, 2017

(54) LIGHTING DEVICE, ILLUMINATION DEVICE, AND LIGHTING FIXTURE

(71) Applicant: Panasonic Intellectual Property Management Co., Ltd., Osaka (JP)

(72) Inventor: Shigeru Ido, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/134,687

(22) Filed: Apr. 21, 2016

(65) Prior Publication Data

US 2016/0316531 A1 Oct. 27, 2016

(30) Foreign Application Priority Data

Apr. 24, 2015 (JP) ..... 2015-089573

(51) Int. Cl.
*H05B 37/00* (2006.01)
*H05B 33/08* (2006.01)

(52) U.S. Cl.
CPC ..... *H05B 33/0827* (2013.01)

(58) Field of Classification Search
CPC ..... H05B 33/0815
USPC ..... 315/201, 185 R, 193, 318
See application file for complete search history.

(56) References Cited

U.S. PATENT DOCUMENTS

2012/0299495 A1* 11/2012 Sakuragi ..... H05B 33/0812 315/201
2015/0103568 A1* 4/2015 Del Carmen, Jr. ..... H02M 3/33507 363/21.16

FOREIGN PATENT DOCUMENTS

JP 2012-244137 A 12/2012

* cited by examiner

*Primary Examiner* — Daniel D Chang
(74) *Attorney, Agent, or Firm* — Renner, Otto, Boisselle & Sklar, LLP

(57) ABSTRACT

A lighting device includes a first current controller, a second current controller, and a charging current controller. The first current controller is configured to control current flowing through a light source so that the current flowing through the light source does not exceed a first predefined value. The charging current controller is configured to control current flowing through a storage element. The second current controller is configured to control current flowing through a first light source so that the current flowing through the first light source does not exceed a second predefined value.

20 Claims, 7 Drawing Sheets

10
101A
101B
100A
100B
3
4
5
D7
D8
D9
D10
2A
2B
2C
20A
20B
20C
C1
C2
C3
D6
D3
D2
C0
D5
D4
D1
11
12
13
14
R21
R22
R23
R24
R2
OP1
C21
C22
ZD21
M2
R11
R12
R13
R1
U1
C11
ZD11
ZD12
M1
R31
R32
R33
R3
U3
C31
ZD31
ZD32
M3
R41
R42
R43
R4
U4
C41
ZD41
ZD42
M4

LIGHTING DEVICE, ILLUMINATION DEVICE, AND LIGHTING FIXTURE

CROSS-REFERENCE TO RELATED APPLICATION

This application claims the benefit of priority of Japanese Patent Application Number 2015-089573, filed on Apr. 24, 2015, the entire contents of which are hereby incorporated by reference.

TECHNICAL FIELD

The present disclosure relates to a lighting device configured to light a solid-state light-emitting element, an illumination device including the lighting device and a light source including a solid-state light-emitting element, and a lighting fixture including the illumination device.

BACKGROUND ART

A light-emitting diode (LED) driving device described in JP 2012-244137A (hereinafter referred to as Document 1) represents as a conventional example of a lighting device. The light-emitting diode driving device (hereinafter referred to as a conventional example) includes a rectifier circuit, an LED unit, a constant current circuit for charging a capacitor (charging circuit), a constant current circuit for discharging a capacitor (discharging circuit), a charging diode, a discharging diode, and a charging-discharging capacitor.

The conventional example is, for example, electrically connected to an AC power supply with an effective value of 100 V, and is configured to rectify an AC voltage of the AC power supply with a rectifier circuit, and to obtain a pulsating voltage with a peak value of approximately 141 V.

A first end of the charging-discharging capacitor and a first end of the discharging circuit are electrically connected to a high potential-side output terminal of the rectifier circuit, and a low potential-side output terminal thereof is electrically connected to ground. An anode of the charging diode and a cathode of the discharging diode are electrically connected to a second end of the charging-discharging capacitor.

A cathode of the charging diode is electrically connected to a second end of the discharging circuit and an anode-side terminal of the LED unit. A cathode of the LED unit is electrically connected to an anode of the discharging diode and a first end of the charging circuit. A second end of the charging circuit is electrically connected to ground.

Next, operations of this conventional example will be described.

First, charging of the charging-discharging capacitor is performed for a period during which a power supply voltage of the AC power supply is high. A charging current flows in a path (hereinafter referred to as a charging path) that passes from the rectifier circuit through the charging-discharging capacitor, the charging diode, the LED unit, and the charging circuit in this order, and charges the discharging-discharging capacitor. The charging current is controlled to a constant current by the charging circuit.

At this time, the LED unit and the charging-discharging capacitor are connected in series, and loss in the charging circuit can be mitigated due to a charged voltage of the charging-discharging capacitor due to a charged voltage of the charging-discharging capacitor, even if a forward voltage of the LED unit is small and a voltage difference thereof to the power voltage is large. Also, the charged voltage of the charging-discharging capacitor is a voltage obtained by subtracting the forward voltage of the LED unit from the power supply voltage at the end of charging. When the charging ends, the current flowing in the charging circuit decreases rapidly, and the discharging circuit starts operation in response to a signal generated when this rapid decrease is detected.

Discharging of the charging-discharging capacitor is performed for a period during which the power supply voltage of the AC power supply is low. The discharge current flows in a path (hereinafter referred to as a discharging path) that passes from the charging-discharging capacitor through the discharging circuit, the LED unit, the discharging diode, and charging-discharging capacitor in this order. Note that the discharge current is controlled to a constant current by the discharging circuit.

Here, a period during which the power supply voltage is higher than the voltage (charged voltage) across the charging-discharging capacitor exists before transitioning from the charging period to the discharging period to the discharging period, and a current flows in the period (hereinafter referred to as a transient period) in a path (hereinafter referred to as a transient path) that passes from the rectifier circuit through the discharging circuit, the LED unit, and the charging-discharging circuit in this order. Note that the current (hereinafter referred to as a transient current) is controlled to a constant current having a current value that is equal to the value of whichever current is smaller between the current in the discharging circuit and the current in the charging circuit (current in the discharging circuit, for example).

According to the conventional example, as described above, the LED unit can be directly driven (lighted) by the pulsating voltage that results from rectification by the rectifier circuit, without the AC electric power supplied from the AC power supply being converted to DC electric power. Moreover, in this conventional example, lighting of the LED unit and charging of the charging-discharging capacitor are performed at the same time by connecting the LED unit and the charging-discharging capacitor in series, for a period during which the pulsating voltage is high, and the LED unit can be lighted by discharging the charging-discharging capacitor for a period during which the pulsating voltage is low.

As a result, since there is no period during which the light source (LED unit) is turned off in one cycle of the power supply voltage, flicking can be suppressed.

Incidentally, in the conventional example described in Document 1, there is a problem in that efficiency decreases since the transient current in the transient period flows in both the charging circuit and the discharging circuit, and loss occurs in each of the charging circuit and the discharging circuit.

SUMMARY

The present disclosure has been made in view of the above-described problems, and an object of the present disclosure is to provide a lighting device, an illumination device, and an illumination fixture, which can improve efficiency compared with the conventional example.

A lighting device according to an aspect of the present disclosure includes a rectifier unit, a first current controller, a second current controller, a storage element, a charging current controller, a first rectifier element, a second rectifier element, a third rectifier element, and a fourth rectifier element. The rectifier unit is configured to rectify a sine wave AC voltage inputted between the pair of input terminals and output a pulsating voltage from the pair of output terminals of the rectifier unit. The first current controller has: a first end that is electrically connected to a light source; and a second end that is electrically connected to the first rectifier element. The first current controller is electrically connected in series to the light source between the pair of output terminals via the first rectifier element and is configured to control the current flowing through the light source so that the current flowing through the light source does not exceed a first predefined value. The charging current controller is electrically connected in series with the storage element to constitute a series circuit with the storage element. The charging current controller is configured to control a discharge current that allows through the storage element. The series circuit has: a first end that is electrically connected to the first end of the first current controller via the second rectifier element; and a second end that is electrically connected to the second end of the first current controller via the fourth rectifier element. The second rectifier element is configured to cause the charging current to the storage element via the light source and not via the first current controller. The third rectifier element and the fourth rectifier element are electrically connected in series to the series circuit of the storage element and the charging current controller and are configured to cause discharge current discharged from the storage element to the light source. The light source includes a first light source and a second light source that are electrically connected in series to each other. The second current controller has: a first end that is electrically connected to a connection point of the first light source and the second light source; and a second end that is electrically connected between the first rectifier element and an output terminal of a low potential side of the pair of output terminals and is configured to control a current flowing through the first light source so that the current flowing through the first light source does not exceed a second predefined value.

An illumination device according to one aspect of the present disclosure includes one or more light sources and the above lighting device. One light source of the one or more light sources includes a first light source and a second light source that are electrically connected in series to each other. The first light source and the second light source each include one or more solid light emitting elements.

A lighting fixture according to one aspect of the present disclosure includes the above illumination device and a fixture body holding the illumination device.

BRIEF DESCRIPTION OF DRAWINGS

The figures depict one or more implementations in accordance with the present teaching, by way of example only, not by way of limitation. In the figures, like reference numerals refer to the same or similar elements.

DESCRIPTION OF EMBODIMENT

A lighting device 1, an illumination device 6, and a lighting fixture 7A to 7C according to an embodiment of the present invention will be specifically described with reference to drawings. Note that the configuration described below is only one example of the present invention, and the present invention is not limited to the following embodiment. Therefore, numerous variations are possible without departing from the inventive aspects described herein.

Figure 1:
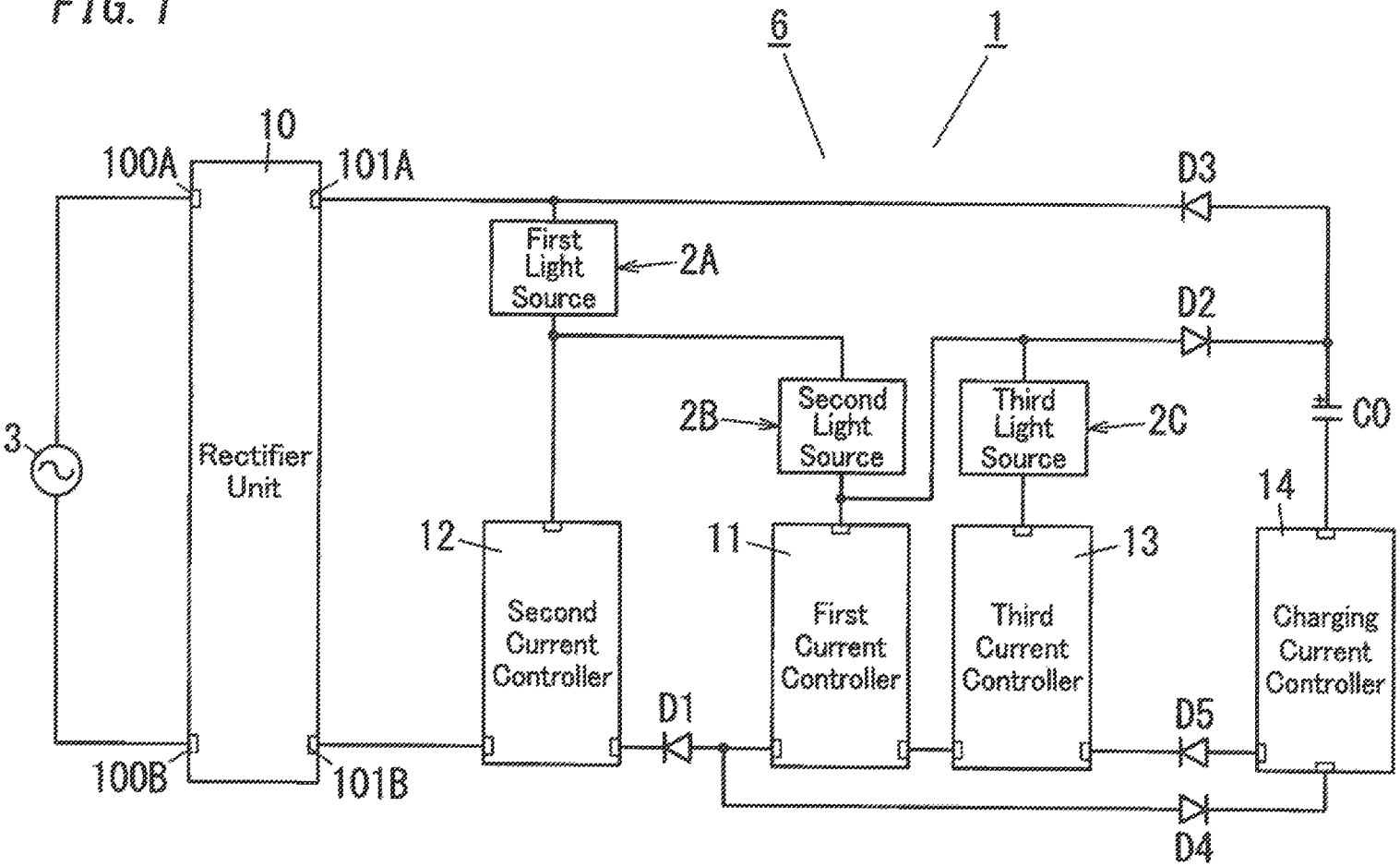
FIG. 1 is a block diagram of a lighting device and an illumination device according to an embodiment of the present invention.

The illumination device 6 according to the present embodiment includes a lighting device 1 and light sources (first light source 2A and second light source 2B) as shown in FIG. 1. Also, furthermore, the illumination device 6 preferably includes a third light source 2C as a light source that is different from the first light source 2A and the second light source 2B.

The lighting device 1 includes a rectifier unit 10, a first current controller 11, a second current controller 12, a capacitor C0 (storage element), a charging current controller 14, and a first rectifier element D1, a second rectifier element D2, a third rectifier element D3, and a fourth rectifier element D4. Furthermore, the lighting device 1 preferably includes a third current controller 13 and a fifth rectifier element D5.

Note that, although each of the first to fifth rectifier elements D1 to D5 is constituted by a diode in the present embodiment, each of the first to fifth rectifier elements D1 to D5 is not limited to a diode.

Figure 2:
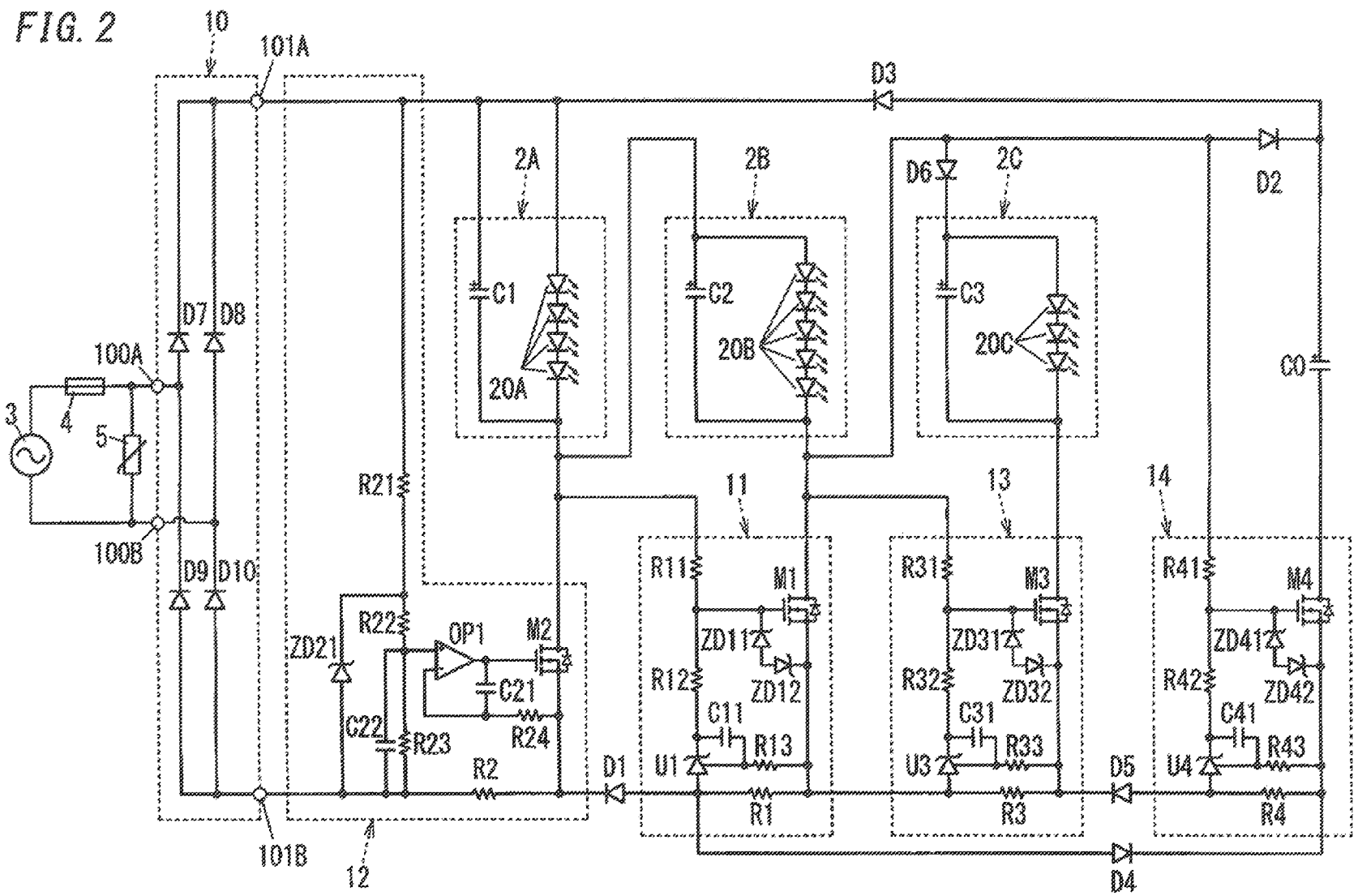
FIG. 2 is a circuit configuration diagram of the lighting device and the illumination device according to the embodiment of the present invention.

The rectifier unit 10 includes a diode bridge that is constituted by four diodes D7 to D10, for example, as shown in FIG. 2, and includes a pair of input terminals 100A and 100B and a pair of output terminals 101A and 101B. An AC power supply 3 is electrically connected between the pair of input terminals 100A and 100B via a fuse 4. Note that it is preferable that a surge absorbing element 5 such as a varistor is electrically connected between the input terminals 100A and 100B of the rectifier unit 10.

The AC power supply 3 supplies a sine wave AC voltage having an effective value of 100 V, for example. Accordingly, a sine wave pulsating voltage having a maximum value (peak value) of $100\times\sqrt{2}\approx141$ V is outputted from between the output terminals 101A and 101B of the rectifier unit 10. Note that the rectifier unit 10 is preferably configured such that one output terminal 101A is at a higher potential than the other output terminal 101B.

As shown in FIG. 2, the first light source 2A includes a series circuit of a plurality of (four in FIG. 2) LEDs 20A and a smoothing capacitor C1 that is electrically connected in parallel to the series circuit. The first light source 2A includes two terminals, namely a positive electrode and a negative electrode, and is configured to emit light (to be lighted) due to current flowing through the LEDs 20A when the potential of the positive electrode relative to the negative electrode is a reference voltage Vf1 or more.

Note that the LED 20A is constituted by a surface mount device (SMD) LED in the present embodiment. However, the LED 20A may be a chip on board (COB) LED. An LED 20B and an LED 20C described below are similar to the LED 20A.

The second light source 2B includes a series circuit of a plurality (five in FIG. 2) of LEDs 20B and a smoothing capacitor C2 that is electrically connected in parallel to the series circuit similar to the first light source 2A. The second light source 2B includes two terminals of a positive electrode and a negative electrode, and is configured to emit light (light) by current flowing through the second light source 2B when voltage between the positive electrode and the negative electrode is a reference voltage Vf2 or more.

The third light source 2C includes a series circuit of a plurality (three in FIG. 2) of LEDs 20C and a smoothing capacitor C3 that is electrically connected in parallel to the series circuit similar to the first light source 2A. The third light source 2C includes a positive electrode and a negative electrode, and is configured to emit light (light) by current flowing through the LED 20C when a voltage between the positive electrode and the negative electrode is a reference voltage Vf3 or more.

Note that the reference voltage Vf1 of the first light source 2A is equal to the total sum of forward voltages of the LEDs 20A that constitutes the series circuit. Additionally, the reference voltage Vf2 of the second light source 2B is equal to the total sum of forward voltages of the LEDs 20B that constitute the series circuit. It is preferable that, in the present embodiment, the total sum of two reference voltages Vf1 and Vf2 of the first and second light sources 2A and 2B is set to less than or equal to half the maximum value of the pulsating voltage, and is 60 V, for example, because the first light source 2A and the second light source 2B are electrically connected in series to each other.

That is to say, the first light source 2A includes k (k is a natural number) LEDs 20A, the second light source 2B includes m (m is a natural number) LEDs 20B, where the following relationship is satisfied: (forward voltage of one LED 20A×k)+(forward voltage of one LED 20B×m)≤60 V.

Furthermore, the reference voltage Vf3 of the third light source 2C is equal to the total sum of forward voltages of the LEDs 20C that constitute the series circuit. It is preferable that, in the embodiment, the reference voltage Vf3 is set to half the total sum of the reference voltage Vf1 of the first light source 2A and the reference voltage Vf2 of the second light source 2B or less. It is preferable that the reference voltage Vf3 is set to, for example, 24 V.

That is to say, when the reference voltage Vf3 is 24 V, for example, the third light source 2C includes a series circuit of n (n is a natural number) LEDs 20C, where n satisfies the following relationship: forward voltage of one LED 20C×n≤24 V.

The reference voltage Vf1 of the first light source 2A and the reference voltage Vf2 of the second light source 2B are preferably set taking into consideration a possible reduced supply voltage of the AC power supply 3. For example, when each of the LEDs 20A and 20B have the forward voltage of 6.2 V, the reference voltage Vf1 and Vf2 satisfy the following relationship: Vf1+Vf2≈56 V (<60 V).

Here, when the pulsating voltage outputted from the rectifier unit 10 is equal to or less than the reference voltage Vf1 of the first light source 2A, no current flows through the first light source 2A. Thus, the reference voltage Vf1 is preferably small so as not to generate a period in which no current flow through the first light source 2A.

However, if the reference voltage Vf1 decreases, the circuit loss increases. Thereby, a voltage ratio between the reference voltage Vf1 of the first light source 2A and the reference voltage Vf2 of the second light source 2B is preferably set to about 1 to 1. Accordingly, in the present embodiment, the number of LEDs 20A in the first light source 2A is four, and the number of LEDs 20B in the second light source 2B is five. That is, in the present embodiment, the following relationship is satisfied: k=4 and m=5.

Also, the reference voltage Vf3 of the third light source 2C is preferably set to 10% to 70% of the sum of the reference voltage Vf1 of the first light source 2A and the reference voltage Vf2 of the second light source 2B. In particular, in the case where luminous efficiency is considered, the reference voltage Vf3 is most efficiently set to 30% to 40% of the sum of the two reference voltages Vf1 and Vf2. For example, when the LED 20C has the forward voltage of 6.2 V, the following relationship is satisfied: Vf3≈19 V. That is, in the present embodiment, the following relationship is satisfied: n=3.

The smoothing capacitor C1 is constituted by an aluminum electrolytic capacitor or a multilayer ceramic capacitor, for example and decrease a surge voltage applied to a series circuit of the LEDs 20A and the like. A current If1 flows through the first light source 2A for an entire period of one cycle (a period equal to a half cycle of the power supply voltage of the AC power supply 3; the same applies hereinafter) of the pulsating voltage, as described later. Accordingly, a small value of approximately 0.1 μF (microfarad) to 1 μF, for example, may suffice for a capacitance of the smoothing capacitor C1.

In a fourth mode as described below of the present embodiment, because the current from the second current controller 12 is superimposed to a discharge current of the capacitor C0, the capacitance of the smoothing capacitor C1 is preferably set to large voltage such as 220 μF.

The smoothing capacitor C2 is constituted by, for example, a multilayer ceramic capacitor and decreases a surge voltage applied to a series circuit of the LEDs 20B. A current If2 flows through the second light source 2B for an entire period of one cycle of the pulsating voltage, as described later. Accordingly, a small value of 0.1 μF to 1 μF, for example, may suffice for the capacitance of the smoothing capacitor C2. Note that in the case where the smoothness is required even in the event of a sharp fluctuation in the applied voltage of the AC power supply 3, the capacitance of the smoothing capacitor C2 may be set to a large value.

The smoothing capacitor C3 is constituted by, for example, a multilayer ceramic capacitor and decreases a surge voltage applied to a series circuit of the LED 20C. A small value of 0.1 μF to 1 μF, for example, may suffice for the capacitance of the smoothing capacitor C3. Note that, in a second mode described later, the current If3 does not flow, and thus, if a reduction of light ripple (flicker of the light) is required, the capacitance of the smoothing capacitor C3 is preferably set to a large value.

For example, when the drain current of the transistor M3 constituting the third current controller 13 is set to 0.1 A, the equivalent resistance of the third light source 2C satisfies the following relationship: Vf3/0.1 A=190Ω. When the capacitance of the smoothing capacitor C3 is 220 μF, the time constant of the third light source 2C satisfies the following relationship: 190×220/1000=41.8 ms. Because the period of the second mode is about 3 ms, it is possible to smooth the voltage.

The first current controller 11 is configured by a constant current circuit that includes a transistor M1 and a shunt regulator U1 (refer to FIG. 2). The transistor M1 is constituted by an n-channel MOSFET (metal-oxide-semiconductor field-effect transistor), for example. However, the transistor M1 may be constituted by a pnp-type bipolar transistor.

A drain of the transistor M1 is electrically connected to the negative electrode of the second light source 2B, and a source of the transistor M1 is electrically connected to a resistor R1. Also, a gate of the transistor M1 is electrically connected to a connection point of two resistors R11 and R12 that constitute a series circuit.

A cathode of the shunt regulator U1 is electrically connected to a first end of the resistor R12 and a first end of a capacitor C11, and an anode of the shunt regulator U1 is electrically connected to a first end of the resistor R1 and an anode of the first rectifier element D1. Also, a reference terminal of the shunt regulator U1 is electrically connected to a second end of the capacitor C11 and a first end of the resistor R13. A second end of the resistor R13 is electrically connected to a second end of the resistor R1.

The resistor R11 is a resistor for biasing the gate of the transistor M1. The first end of the resistor R11 is electrically connected to the negative electrode of the first light source 2A and the positive electrode of the second light source 2B.

Also, a cathode of the Zener diode ZD11 is electrically connected to the gate of the transistor M1, and an anode of the Zener diode ZD11 is electrically connected to an anode of the Zener diode ZD12. Furthermore, a cathode of the Zener diode ZD12 is electrically connected to a source of the transistor M1. The Zener diodes ZD11 and ZD12 prevent the gate film of the transistor M1 from being broken by a voltage surge.

Here, the resistor R13 and the capacitor C11 constitutes a phase compensation circuit for decreasing oscillation of the shunt regulator U1. In the phase compensation circuit, a resistance of the resistor R13 is set to 2 kΩ, and a capacitance of the capacitor C11 is set to 1 nF, for example, so that cut-off frequency of the shunt regulator U1 is equal to or less than 100 kHz. Accordingly, the cut-off frequency of the shunt regulator U1 can be set to 80 kHz.

The first current controller 11 controls (to be constant current) a drain current of the transistor M1 by increasing or decreasing a cathode current (gate voltage) such that a voltage (voltage drop) generated across the resistor R1 matches a reference voltage of the shunt regulator U1. The reference voltage of the shunt regulator U1 is 1.24 V, for example. If a resistance value of the resistor R1 is 12.4Ω, the shunt regulator U1 controls the transistor M1 such that a current (=100 mA) flows that causes the voltage across the resistor R1 to be 1.24 V.

The third current controller 13 is constituted, like the first current controller 11, by a constant current circuit that includes the transistor M3 and the shunt regulator U3 (refer to FIG. 2). Note that the construction of the third current controller 13 is common to that of the first current controller 11 except that the reference signs added to respective elements are different. Therefore, detailed description of the third current controller 13 will be omitted.

Also, the charging current controller 14 is constituted by, similarly to the first current controller 11, a constant current circuit including a transistor M4 and a shunt regulator U4 (refer to FIG. 2). Note that the circuit configuration of the charging current controller 14 is in common with that of the first current controller 11, except that the reference signs added to respective elements are different. Therefore, detailed description of the charging current controller 14 will be omitted.

Note that the current flowing through the transistors M3 and M4 may be as large as the current flowing through the transistor M1. On the other hand, the current flowing through the transistors M3 and M4 may be set to be proportional to the supply voltage of the AC power supply 3. Accordingly, it is possible to reduce the noise transmitted on the power line and improve the power factor.

The second current controller 12 is constituted by a constant current circuit that includes a transistor M2 and an operational amplifier OP1 (refer to FIG. 2). A drain of the transistor M2 is electrically connected to a negative electrode of the first light source 2A and a positive electrode of the second light source 2B, and a source of the transistor M2 is electrically connected to the resistor R2 (current detector). Also, a gate of the transistor M2 is electrically connected to an output terminal of the operational amplifier OP1.

The non-inverting input terminal of the operational amplifier OP1 is electrically connected to a first end of the capacitor C22 and a connection point of the resisters R22 and R23 in the series circuit of the resistors R21, R22, and R23. A second end of the capacitor C22 is electrically connected to a first end of the resistor R2. A second end of the resistor R2 is electrically connected to a source of the transistor M2 and a cathode of the first rectifier element D1.

The inverting input terminal of the operational amplifier OP1 is electrically connected to a first end of the resistor R24, and a second end of the resistor R24 is electrically connected to a source of the transistor M2. Additionally, the capacitor C21 is electrically connected to between the inverting input terminal of the operational amplifier OP1 and the output terminal.

The Zener diode ZD21 is electrically connected between a connection point of the resistors R21 and R22 and the output terminal 101B of the rectifier unit 10. The voltage across the non-inverting input terminal of the operational amplifier OP1 is limited by the Zener diode ZD21. Additionally, the capacitor C22 prevents the voltage across the non-inverting input terminal of the operational amplifier OP1 from changing rapidly.

In this second current controller 12, the pulsating voltage outputted from the rectifier unit 10 is divided by three resistors R21, R22, and R23, and the divided voltage is inputted to the non-inverting input terminal of the operational amplifier OP1. The voltage inputted to the non-inverting input terminal has a value that satisfy the following relationship: Vin×(r23/(r21+r22+r23)), where Vin is a voltage value of the pulsating voltage outputted from the rectifier unit 10, r21, r22, and r23 are respectively the resistance value of the resistors R21, R22, and R23.

Furthermore, the second current controller 12 controls (to be constant current) a drain current of the transistor M2 by increasing or decreasing a gate voltage such that a voltage (voltage drop) generated across the resistor R2 matches a reference voltage of the operational amplifier OP1. Note that the capacitor C21 and the resistor R24 constitute a phase compensation circuit for decreasing oscillation of the operational amplifier OP1. The second predefined value is a current value when a voltage of the resistor R2 is the reference voltage of the operational amplifier OP1.

Note that the elements having the same characteristic as each other are preferably used as the transistor M1 of the first current controller 11, the transistor M2 of the second current controller 12, the transistor M3 of the third current controller 13, and the transistor M4 of the charging current controller 14.

A series circuit of the first light source 2A and the second current controller 12 is electrically connected between output terminals 101A and 101B of the rectifier unit 10. Also, a series circuit of the second light source 2B and the first current controller 11 is electrically connected in parallel to the second current controller 12. Furthermore, a series circuit of the third light source 2C and the third current controller 13 is electrically connected in parallel to the first current controller 11.

Note that a sixth rectifier element D6 is preferably inserted between the third light source 2C and the third current controller 13, while the cathode thereof being on the third light source 2C side. The sixth rectifier element D6 is provided to prevent charges accumulated in the smoothing capacitor C3 of the third light source 2C from being discharged via a parasitic diode of the transistor M3.

That is, when the voltage between the source and drain of the transistor M3 is less than the voltage across the smoothing capacitor C3, electric charges charged in the smoothing capacitor C3 may be discharged through the transistor M1, the resistor R3, and a parasitic diode of the transistor M3. Therefore, in the case where a MOSFET is used as the transistor M3, the sixth rectifier element D6 is preferably inserted somewhere in the discharging path.

Furthermore, a series circuit of a capacitor C0, the charging current controller 14, and the fifth rectifier element D5 is electrically connected in parallel to the first current controller 11 via the second rectifier element D2. That is, a resistor R4 of the charging current controller 14, the fifth rectifier element D5, the resistor R3 of the third current controller 13, the resistor R1 of the first current controller 11, the first rectifier element D1, and the resistor R2 of the second current controller 12 are electrically connected in series to the output terminal 101B of the rectifier unit 10.

Also, an anode of the third rectifier element D3 is electrically connected to a connection point of a cathode of the second rectifier element D2 and the capacitor C0, and a cathode of the third rectifier element D3 is electrically connected to the output terminal 101A of the rectifier unit 10. Furthermore, a cathode of the fourth rectifier element D4 is electrically connected to a connection point of a source of the transistor M4 and the resistor R4, and an anode of the fourth rectifier element D4 is electrically connected to a connection point of an anode of the shunt regulator U1 and the resistor R1.

Also, an anode of the first rectifier element D1 is electrically connected to a connection point of an anode of the shunt regulator U1 and the resistor R1, and a cathode of the first rectifier element D1 is electrically connected to a connection point of a source of the transistor M2 and the resistor R2.

The voltage is applied to the capacitor C0, which is equal to or less than a difference voltage between the maximum value of the pulsating voltage and the reference voltage Vf1 of the first light source 2A (≈141−56=85 V), and a difference voltage between the maximum value of the pulsating voltage and the reference voltage Vf2 of the second light source 2B (≈141−56=85 V). Accordingly, the capacitor C0 preferably includes an aluminum electrolytic capacitor or a multilayer ceramic capacitor having a withstand voltage of 100 V or more.

Incidentally, the first current controller 11, the second current controller 12, the third current controller 13, and the charging current controller 14 operate while influencing each other as described below.

Not only the output current of the first current controller 11 but also the output currents of the third current controller 13 and the charging current controller 14 flow through the resistor R1 of the first current controller 11. As a result of the output current of the third current controller 13 or the charging current controller 14 increasing and the voltage across the resistor R1 increasing, the output current of the first current controller 11 decreases. Then, when the voltage drop in the resistor R1 (voltage across the resistor R1) due to the output current of the third current controller 13 or the charging current controller 14 reaches the reference voltage of the shunt regulator U1, the first current controller 11 stops operation.

Similarly, not only the output current of the second current controller 12 but also the output currents of the first current controller 11, the third current controller 13, and the charging current controller 14 flow through the resistor R2 of the second current controller 12. That is, as a result of the output current of the first current controller 11, the third current controller 13, or the charging current controller 14 increasing and the voltage across the resistor R2 increasing, the output current of the second current controller 12 decreases. Then, when the voltage drop in the resistor R2 (voltage across the resistor R2) due to the output current of the first current controller 11, the third current controller 13, or the charging current controller 14 reaches the reference voltage of the operational amplifier OP1, the second current controller 12 stops operation.

Similarly, not only the output current of the third current controller 13 but also the output current of the charging current controller 14 flow through the resistor R3 of the third current controller 13. That is, as a result of the output current of the charging current controller 14 increasing and the voltage across the resistor R3 increasing, the output current of the third current controller 13 decreases. Then, when the voltage drop in the resistor R3 (voltage across the resistor R3) due to the output current of the charging current controller 14 reaches the reference voltage of the shunt regulator U3, the third current controller 13 stops operation.

Next, operation of the lighting device 1 and illumination device 6 of the present embodiment will be described, with reference to the circuit block diagrams of FIGS. 3A to 3E, the wave form diagram of FIG. 4, and the time chart of FIG. 5. There are five operation modes (first mode to fifth mode) in the lighting device 1 of the present embodiment.

The first mode is an operation mode when the output voltage (pulsating voltage) of the rectifier unit 10 is greater than or equal to a voltage that is the sum of the two reference voltages Vf1 and Vf2 and less than a voltage that is the sum of the three reference voltage Vf1, Vf2, and Vf3. In the first mode, a current If2 flows through the first light source 2A and the second light source 2B in a path that passes from the rectifier unit 10 through the first light source 2A, the second light source 2B, the first current controller 11, the first rectifier element D1, and the rectifier unit 10 in this order, as shown by the solid line a1 in FIG. 3A. Then, the first light source 2A and the second light source 2B are lighted by the current If2.

The second mode is an operation mode when the output voltage of the rectifier unit 10 is greater than or equal to the voltage that is the sum of the three reference voltages Vf1, Vf2, and Vf3 and less than a voltage that is the sum of the reference voltages Vf1 and Vf2 and the voltage VC0 across the capacitor C0. In the second mode, a current If3 flows through the first light source 2A and the second light source 2B in a path that passes from the rectifier unit 10 through the first light source 2A, the second light source 2B, the third light source 2C, the third current controller 13, the first rectifier element D1, and the rectifier unit 10 in this order, as shown by a solid line a2 in FIG. 3B. Then, the first light source 2A, the second light source 2B, and the third light source 2C are lighted, and the smoothing capacitor C3 is charged, by the current If3.

The third mode is an operation mode when the output voltage of the rectifier unit 10 is greater than or equal to the voltage that is the sum of the two reference voltages Vf1 and Vf2 and the voltage VC0 across the capacitor C0. In the third mode, a charging current flows in a path that passes from the rectifier unit 10 through the first light source 2A, the second light source 2B, the second rectifier element D2, the capacitor C0, the charging current controller 14, the fifth rectifier element D5, the first rectifier element D1, and the rectifier unit 10 in this order, as shown by the solid line a3 in FIG. 3C. Then, the first light source 2A and the second light source 2B are lighted, and the capacitor C0 is charged, with this charging current.

The fourth mode is an operation mode when the output voltage of the rectifier unit 10 is equal to or more than the reference voltage Vf1 and less than the sum of two reference voltages Vf1 and Vf2. In the fourth mode, as shown by a solid line a5 in FIG. 3D, the discharge current from the capacitor C0 flows through the third rectifier element D3, the first light source 2A, the second light source 2B, the first current controller 11, the fourth rectifier element D4, the charging current controller 14, and the capacitor C0 in this order. Thus, by the discharge current, the first light source 2A and the second light source 2B are turned on.

Figure 3A:
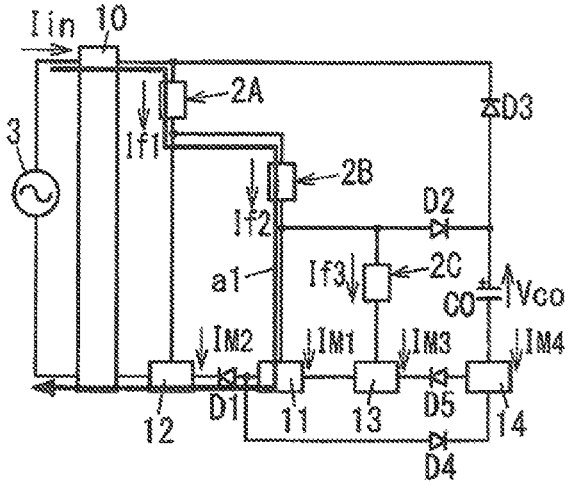
FIGS. 3A to 3E are block diagrams for describing operations of the lighting device and the illumination device according to the embodiment of the present invention.
Figure 3D:
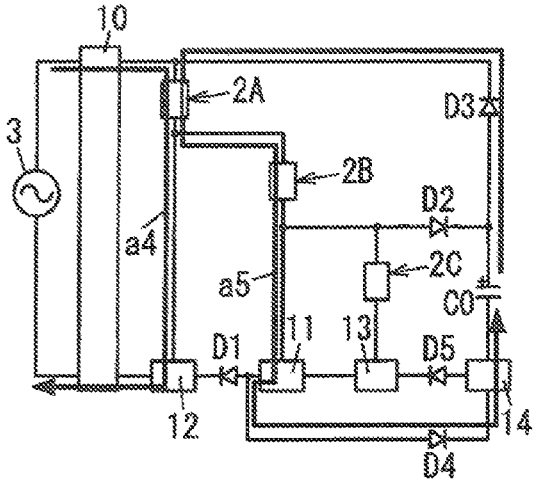
Figure 3B:
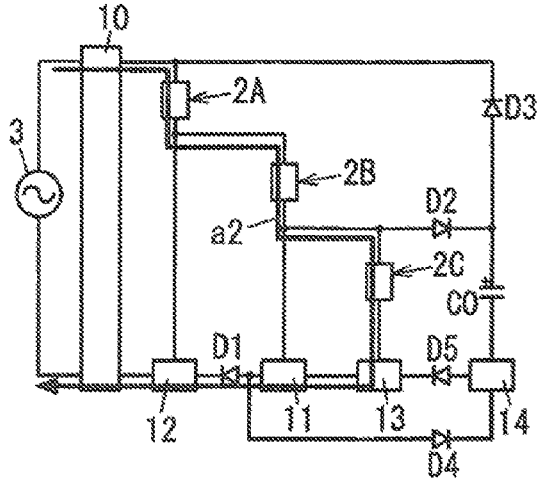
Figure 3E:
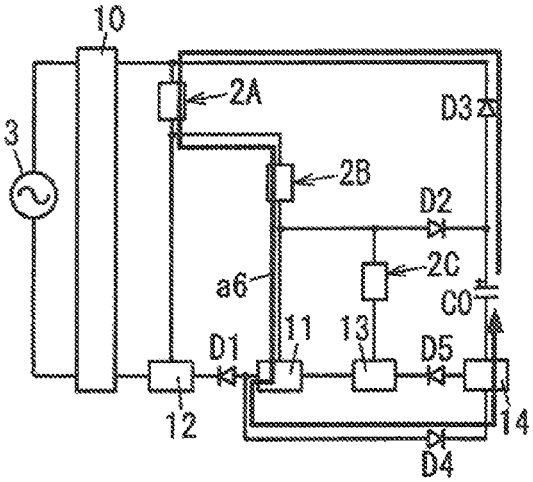
Figure 3C:
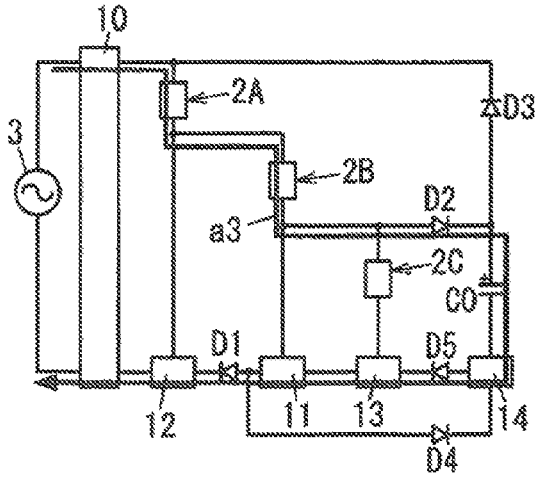

In this case, because the output voltage of the rectifier unit 10 is equal to or more than the reference voltage Vf1, as shown by a solid line a4 in FIG. 3D, the current If1 flows in a path that passes from the rectifier unit 10 through the first light source 2A, the second current controller 12, and the rectifier unit 10 in this order. That is, in the fourth mode, the charging current of the capacitor C0 and the current If1 of the second current controller 12 flow through the first light source 2A, and thus the amount of light emitting of the first light source 2A increases.

In this case, when the current If1 flows through the first light source 2A by the second current controller 12, the voltage across the resistor R2 increases, and thus the cathodic potential of the first rectifier element D1 is higher than the anodic potential of the first rectifier element D1. Accordingly, the ground of the second current controller 12 is separated from the ground of the first current controller 11, the third current controller 13, and the charging current controller 14 by the first rectifier element D1. Note that the potential difference between the anode and the cathode of the first rectifier element D1 is a discharge voltage of the capacitor C0, in the present embodiment, about 70 V, for example.

The fifth mode is an operation mode when the output voltage of the rectifier unit 10 is lower than the reference voltage Vf1. In the fifth mode, discharge current flows through the first light source 2A and the second light source 2B in a path that passes from the capacitor C0 through the third rectifier element D3, the first light source 2A, the second light source 2B, the first current controller 11, the fourth rectifier element D4, the charging current controller 14, and the capacitor C0 in this order, as shown by the solid line a6 in FIG. 3E. Then, the first light source 2A and the second light source 2B are lighted by the discharge current.

Note that, even in the fifth mode, the cathodic potential of the first rectifier element D1 is higher than the anodic potential. Accordingly, the ground of the second current controller 12 is divided from the ground of the first current controller 11, the third current controller 13, and the charging current controller 14 by the first rectifier element D1.

Then, the lighting device 1 according to the embodiment operates in the fifth mode, the fourth mode, the first mode, the second mode, the third mode, the second mode, the first mode, the fourth mode, and the fifth mode in this order in one period when the output voltage of the rectifier unit 10 increases from 0 V to the maximum value (141 V) and then return to 0 V.

Figure 4:
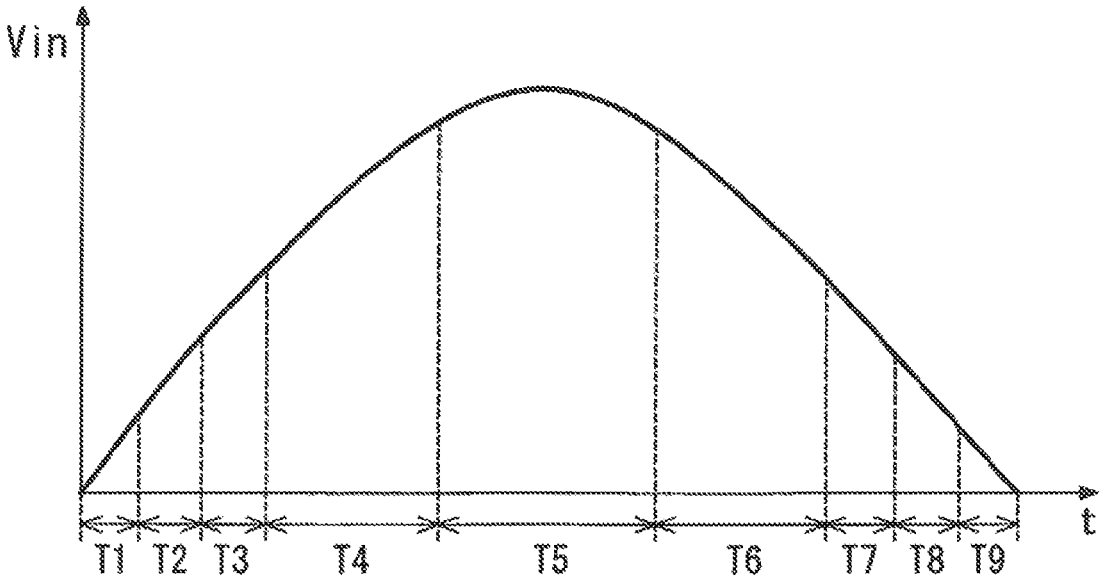
FIG. 4 is a waveform diagram of pulsating voltage outputted from a rectifier unit of the lighting device and the illumination device according to the embodiment of the present invention.

FIG. 4 shows a waveform of pulsating voltage outputted from the rectifier unit in one period. FIG. 5 shows current through each unit when the lighting device 1 according to the embodiment performs the steady operation.

Figure 5:
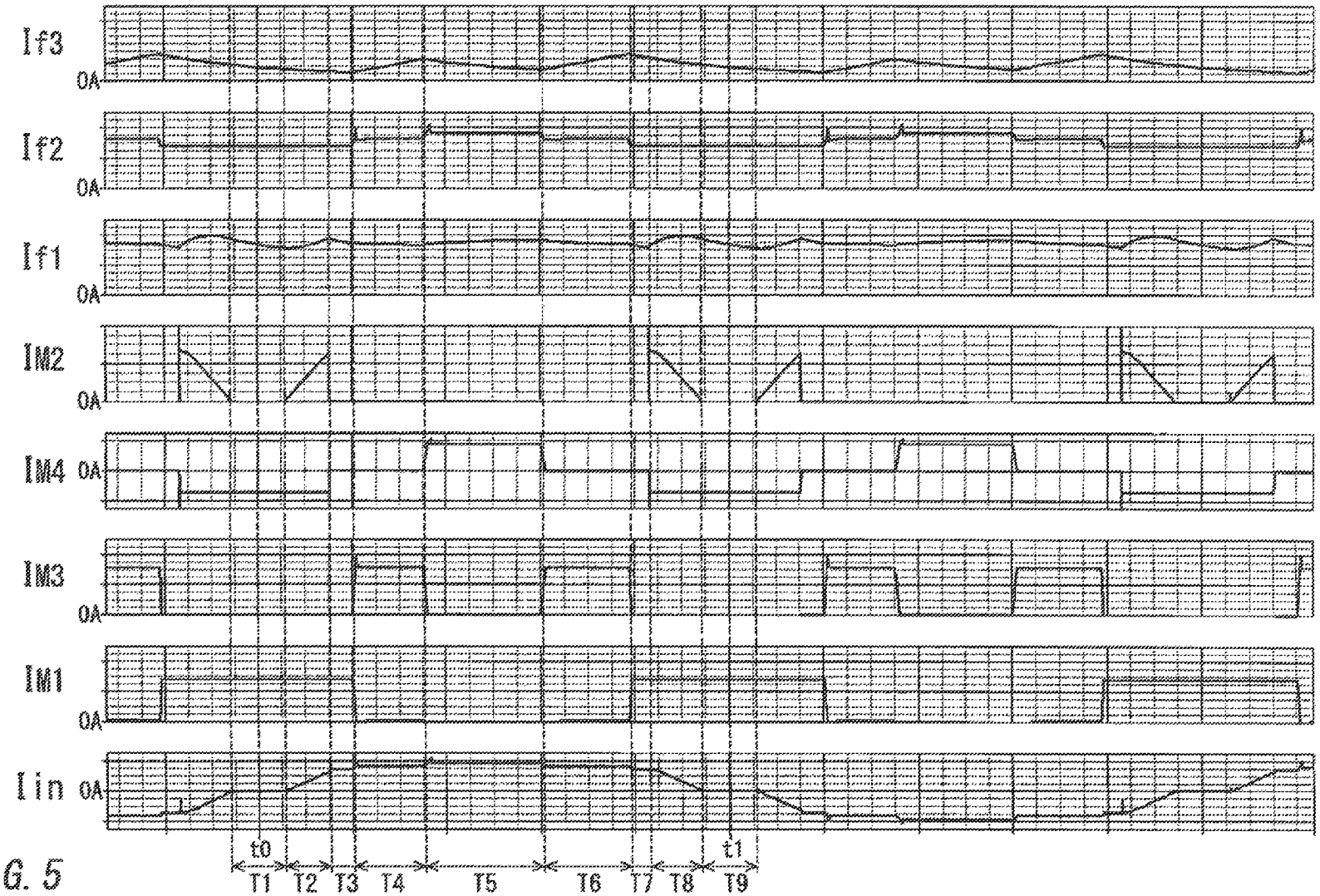
FIG. 5 is a time chart for describing operations of the lighting device and the illumination device according to the embodiment of the present invention.

In FIG. 5, IM4 is a drain current of the transistor M4 in the charging current controller 14, IM3 is a drain current of the transistor M3 in the third current controller 13. Also, in FIG. 5, IM2 is a drain current of the transistor M2 in the second current controller 12, IM1 is a drain current of the transistor M1 in the first current controller 11. Furthermore, tin in FIG. 5 is an input current that flows into the output terminals 101A and 101B of the rectifier unit 10 from the AC power supply 3.

Time t=t0 is a zero crossing point of the pulsating voltage (power supply voltage of the AC power supply 3), and the output voltage of the rectifier unit 10 (pulsating voltage) is 0 V. At this time, since the output voltage of the rectifier unit 10 is less than the reference voltage Vf1, the input current Iin does not flow, the lighting device 1 operates in the fifth mode (period T1 in FIG. 4 and FIG. 5). Therefore, in the period T1 including time t=t0, with the discharge current of the capacitor C0, the first light source 2A and the second light source 2B are lighted.

When the output voltage of the rectifier unit 10 increases and reaches to the reference voltage Vf1, the lighting device 1 shifts to the fourth mode, and the first light source 2A and the second light source 2B are continually lighted (period T2 in FIGS. 4 and 5). Note that, in the period T2, the drain current IM2 of the second current controller 12 flows through the first light source 2A in addition to the discharge current of the capacitor C0. Accordingly, the first light source 2A lights in the period T2 more brightly than the period T1.

When the output voltage of the rectifier unit 10 reaches the sum of the two reference voltages Vf1 and Vf2, the lighting device 1 shifts to the first mode (period T3 in FIGS. 4 and 5). In the period T1, the output voltage of the rectifier unit 10 is greater than the voltage VC0 across the capacitor C0, and the capacitor C0 stops discharging. Additionally, in the period T1, the first current controller 11 operates, and then the first light source 2A and the second light source 2B are turned on. In this time, a drain current IM1 of the first current controller 11 flows through the resistor R2 via the first rectifier element D1, and then, the voltage across the resistor R2 increases, and the transistor M2 is switched from on to off.

When the output voltage of the rectifier unit 10 reaches to the sum of the three reference voltages Vf1, Vf2, and Vf3, the lighting device 1 shifts to the second mode (period T4 in FIGS. 4 and 5). In the period T4, the third current controller 13 operates, and thus the first light source 2A, the second light source 2B, and the third light source 2C are turned on. In this time, a drain current IM3 of the third current controller 13 flows through the resistor R1, and thus the voltage across the resistor R1 increases, and the transistor M1 is switched from on to off.

When the output voltage of the rectifier unit 10 reaches to the sum of the voltage VC0 across the capacitor C0 and the two reference voltages Vf1 and Vf2, the lighting device 1 shifts to the third mode (period T5 in FIGS. 4 and 5). In the period T5, the charging current controller 14 operates, and then, the first light source 2A and the second light source 2B are turned on, and the capacitor C0 is charged. In this time, a drain current IM4 of the charging current controller 14 flows through the resistor R3 via the fifth rectifier element D5, and then, the voltage across the resistor R3 increases, and the transistor M3 is switched from on to off.

When the output voltage of the rectifier unit 10 falls below the sum of the voltage VC0 across the capacitor C0 and the two reference voltages Vf1 and Vf2 after exceeding the maximum value, the lighting device 1 shifts to the second mode (period T6 in FIGS. 4 and 5). In the period T6, the capacitor C0 is stopped to charge, and the third current controller 13 operates, and then, the first light source 2A, the second light source 2B, and the third light source 2C are turned on. In the period T6, the voltage VC0 across the capacitor C0 is maintained. Note that the transistor M4 of the charging current controller 14 is maintained in an on-state.

When the output voltage of the rectifier unit 10 falls below the sum of the three reference voltages Vf1, Vf2, and Vf3, the lighting device 1 shifts to the first mode (period T7 in FIGS. 4 and 5). In the period T7, the first current controller 11 operates, and then, the first light source 2A and the second light source 2B are turned on. In this time, the transistor M3 of the third current controller 13 and the transistor M4 of the charging current controller 14 are maintained at on states. In this time, the voltage VC0 across the capacitor C0 is maintained.

When the output voltage of the rectifier unit 10 falls below the two reference voltages Vf1 and Vf2, the lighting device 1 shifts to the fourth mode (period T8 in FIGS. 4 and 5). In this time, the second light source 2B is turned on by the charging current of the capacitor C0, and the first light source 2A is turned on by the charging current of the capacitor C0 and the drain current IM2 of the second current controller 12. Accordingly, the voltage VC0 across the capacitor C0 decreases by discharging.

When the output voltage of the rectifier unit 10 falls below the reference voltage Vf1, the lighting device 1 shifts to the fifth mode (period T9 in FIGS. 4 and 5). The time t=t1 is a zero crossing point of the pulsating voltage like the time t=t0. In this time, the first light source 2A and the second light source 2B are turned on by the discharge current of the capacitor C0.

Here, in the conventional example described in Document 1, a transient current during the transient period flows through both of the discharge circuit and the charge circuit, and then, the loss occurs in each of the discharge circuit and the charge circuit. Accordingly, there is the problem in that the efficiency decreases.

On the other hand, the lighting device 1 according to the embodiment is configured to operate only any one of the first current controller 11 (or the second current controller 12, or the third current controller 13), or the charging current controller 14 in any operation mode of the first to fifth modes, as described above. That is, in the lighting device 1 according to the embodiment, the first current controller 11 (or the second current controller 12, or the third current controller 13) and the charging current controller 14 is not included in the same closed circuit, and thus it is possible to improve the efficiency compared with the conventional example described in Document 1.

Additionally, the lighting device 1 according to the embodiment is configured to cause the drain current IM2 of the transistor M2 to flow through the first light source 2A in addition to the discharge current of the capacitor C0 in the fourth mode. That is, the light output can be increased even in the periods T2 and T8 when the power supply voltage of the AC power supply 3 is low. Accordingly, light ripple is decreased. Furthermore, in the lighting device 1 according to the embodiment, as described above, pause periods of the input current Iin (periods T1 and T9 in FIG. 5) are shorter, and thus it is possible to reduce distortion of the input current.

Also, when the forward voltage of the first light source 2A is lower than the forward voltage of the second light source 2B, it is possible to suppress an increase in circuit loss while the pause period of the input current from the rectifier unit 10 is shorter.

Figure 6:
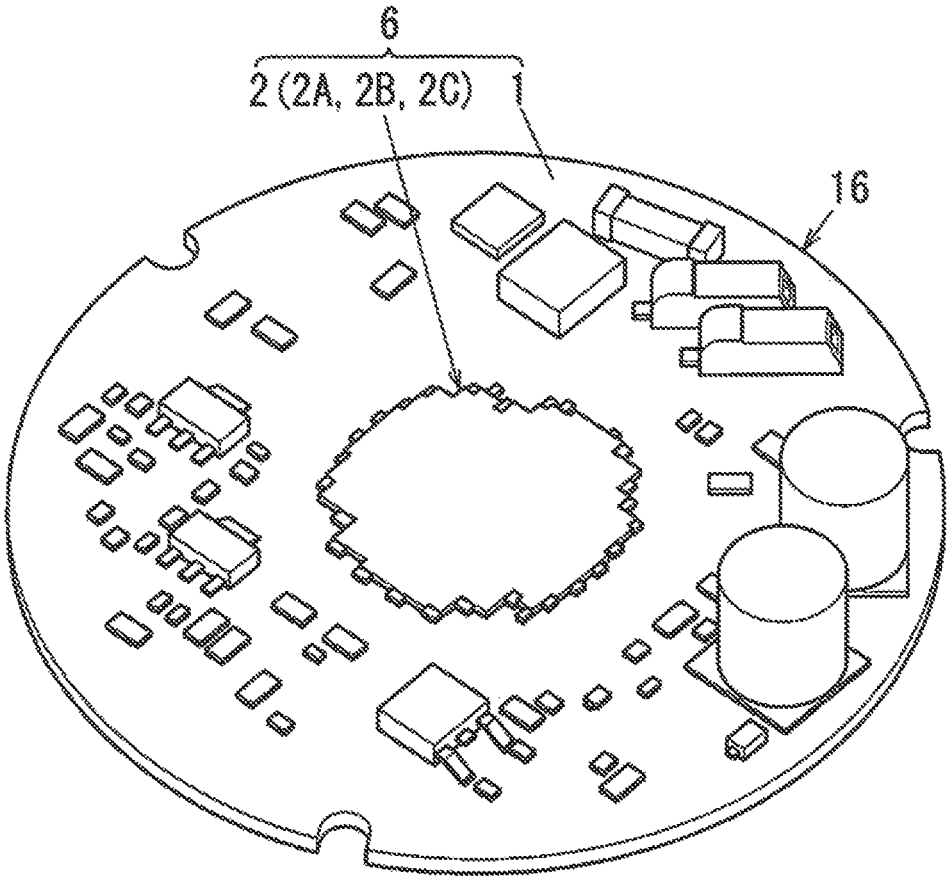
FIG. 6 is a perspective view of a structure of the lighting device and the illumination device according to the embodiment of the present invention.

Incidentally, as shown in FIG. 6, the lighting device 1 described above may be integrally formed with the plurality of light sources 2 (first light source 2A, second light source 2B, and third light source 2C). For example, the LEDs 20A, 20B, and 20C are mounted on the center of one surface (mounting surface) of the mounting substrate 16 that is formed in the disc-shape, and various circuit components constituting the lighting device 1 are mounted surround the LEDs 20A, 20B, and 20C on the mounting surface.

As described above, the illumination device 6 is constituted by the light source 2 and the lighting device 1 being mounted on one mounting substrate 16, and thereby it is possible to downsize the illumination device 6 compared with the case where the light source 2 is separately formed from the lighting device 1.

Next, lighting fixtures 7A to 7C according to the embodiment will be described in detail with reference to FIGS. 7A to 7C.

Figure 7C:
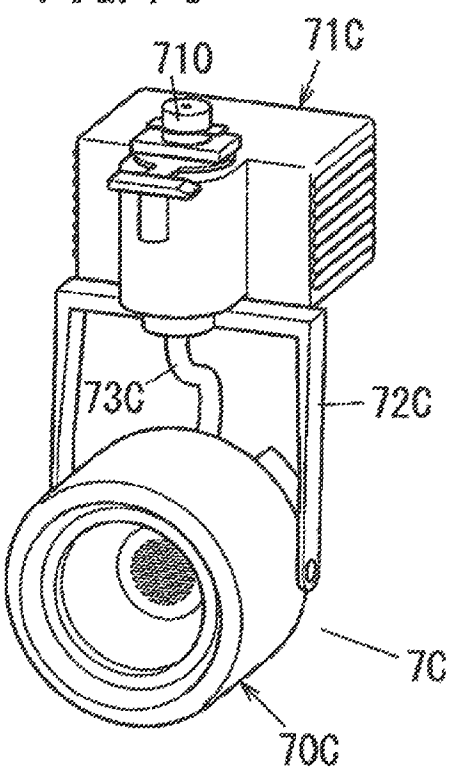
FIGS. 7A to 7C are perspective views of a lighting fixture according to the embodiment of the present invention.
Figure 7B:
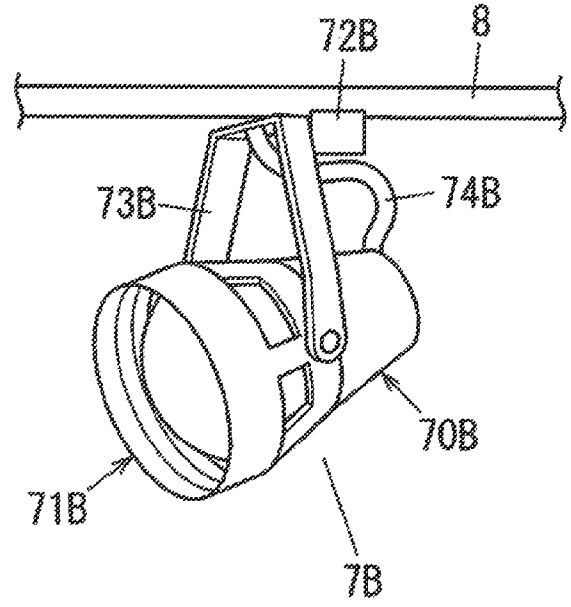
Figure 7A:
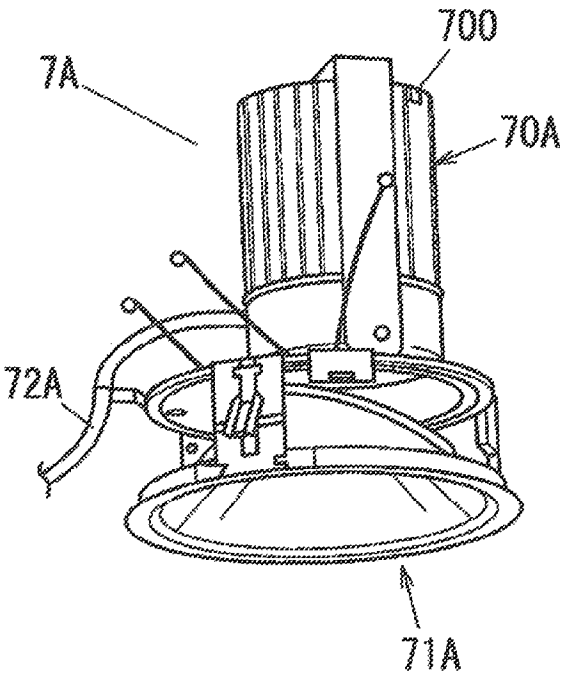

The lighting fixture 7A according to the embodiment may be a down light that is embedded and arranged in a ceiling, as shown in FIG. 7A, for example. The lighting fixture 7A includes the light source 2 (first light source 2A, second light source 2B, and third light source 2C) and a fixture body 70A that houses the lighting device 1 and a reflector 71A. A plurality of radiation fins 700 are provided in an upper portion of the fixture body 70A. A power cable 72A that is led out from the fixture body 70A is electrically connected to the AC power supply 3.

Alternatively, the lighting fixtures 7B and 7C according to the embodiment may be preferably configured as a spot light to be attached to a wiring duct 8, as shown in FIGS. 7B and 7C. A lighting fixture 7B shown in FIG. 7B includes the light source 2 (first light source 2A, second light source 2B, and third light source 2C) and a fixture body 70B that houses the lighting device 1 and a reflector 71B. Also, the lighting fixture 7B includes a connector portion 72B that is attached to the wiring duct 8, and an arm portion 73B that couples the connector portion 72B and the fixture body 70B. The connector portion 72B and the lighting device 1 are electrically connected via a power cable 74B.

The lighting fixture 7C shown in FIG. 7C includes: a fixture body 70C that houses the light source 2; a box 71C that houses the lighting device 1; a connection portion 72C that connects the fixture body 70C and the box 71C; and a power cable 73C that electrically connects the light source 2 and the lighting device 1. A connector portion 710 that is to be electrically and mechanically connected to the wiring duct 8 in a detachable manner is provided on an upper surface of the box 71C.

As described above, it is possible to provide the lighting fixtures 7A, 7B, and 7C that improve the efficiency compared with the conventional example by using the lighting device 1 according to the present embodiment. Also, similarly, it is possible to increase the light output even during the period when the power supply voltage of the AC power supply 3 is low, and thus it is possible to reduce light ripple. Furthermore, the pause period of the input current tin from the rectifier unit 10 is shorter, and thus it is possible to reduce the distortion of the input current.

Note that, in the present embodiment, the output voltage Vin of the rectifier unit 10 is detected with the series circuit of the resistors R21, R22, and R23. However, a voltage of a connection point of the first light source 2A and the second light source 2B may be detected. Also, in the present embodiment, because the transistor M4 of the charging current controller 14 is the on state when the capacitor C0 is discharged, the cathode of the fourth rectifier element D4 is connected to the source of the transistor M4. However, the cathode of the fourth rectifier element D4 may be connected to the negative electrode of the capacitor C0 not via the transistor M4.

As described above, the lighting device 1 according to the embodiment includes the rectifier unit 10, the first current controller 11, the second current controller 12, the storage element (capacitor C0), and the charging current controller 14. The lighting device 1 further includes the first rectifier element D1, the second rectifier element D2, the third rectifier element D3, and the fourth rectifier element D4. The rectifier unit 10 is configured to rectify a sine wave AC voltage inputted between the pair of input terminals 100A and 100B to output the pulsating voltage from the pair of output terminals 101A and 101B. The first current controller 11 includes the first end that is electrically connected to the light source, and the second end that is electrically connected to the first rectifier element D1. The first current controller 11 is electrically connected in series to the light source (first light source 2A and second light source 2B) between the pair of output terminals 101A and 101B through the first rectifier element D1. The first current controller 11 is configured to control the current flowing through the light source so that the current flowing through the light source does not exceed the first predefined value (for example, 100 mA). The charging current controller 14 is electrically connected in series to storage element to constitute a series circuit with the storage element, and is configured to control the charging current flowing through the storage element. The series circuit includes the first end that is electrically connected to the first end of the first current controller 11 via the second rectifier element D2, and the second end that is electrically connected to the second end of the first current controller 11 via the fourth rectifier element D4. The second rectifier element D2 is configured to make the charging current flow through the storage element through the light source and not through the first current controller 11. The third rectifier element D3 and the fourth rectifier element D4 are electrically connected in series to the series circuit of the storage element and the charging current controller 14, and are configured to make the discharge current discharged from the storage element flow through the light source. The light source includes the first light source 2A and the second light source 2B that are electrically connected in series to each other. The second current controller 12 has a first end connected to the connection point of the first light source 2A and the second light source 2B and a second end electrically connected between first rectifier element D1 and the output terminal 101B of the low potential side of the pair of output terminals 101A and 101B. The second current controller 12 is configured to control the current flowing through the first light source 2A so that the current flowing through the first light source 2A exceeds the second predefined value.

As described above, the lighting device 1 according to the embodiment is configured so that no current flow through the first current controller 11 and the charging current controller 14 at the same time, and thus it is possible to improve the efficiency compared with the conventional example described in Document 1. Also, the lighting device 1 is configured so that the current by the second current controller 12 flows through the first light source 2A in addition to the charging current of the storage element, and it is possible to increase the light output even during the period in which the power supply voltage is low, and thus it is possible to reduce light ripple.

Also, as the lighting device 1 according to the embodiment, the second current controller 12 preferably includes the current detector (resistor R2) that is configured to detect the current flowing through the first light source 2A. The current detector is electrically connected between the first rectifier element D1 and the output terminal 101B of the low potential side of the pair of output terminals 101A and 101B. The second current controller 12 is configured to control the current flowing through the first light source 2A so that the detection current by the current detector is identical with the second predefined value.

It is possible to perform the feedback control by the lighting device 1 according to the embodiment being configured as described above.

Also, as the lighting device 1 according to the embodiment, the second current controller 12 is preferably configured so as to increase/decrease the current that flows through the first light source 2A according to the pulsating voltage output from between the pair of output terminals 101A and 101B.

It is possible to perform the lighting control according to the pulsating voltage outputted from the pair of output terminals 101A and 101B by the lighting device 1 according to the embodiment being configured as described above.

The illumination device 6 according to the embodiment includes one or more light sources 2 (first light source 2A, second light source 2B, and third light source 2C) and any of the above lighting devices 1. One of the one or more light sources 2 includes the first light source 2A and the second light source 2B that are electrically connected in series to each other. The first light source 2A and the second light source 2B each include one or more solid light emitting elements (LED 20A and LED 20B).

The illumination device 6 according to the embodiment includes any of the lighting devices 1, and accordingly has an effect of enabling efficiency to be improved compared with a conventional illumination device.

Also, as the illumination device 6 according to the embodiment, the first light source 2A is preferably configured so as to have a lower forward voltage than the second light source 2B.

It is possible to reduce the circuit loss while the pause period of the input current from the rectifier unit 10 by the illumination device 6 according to the embodiment being configured as described above.

The lighting fixtures 7A, 7B, and 7C according to the embodiment include any of the illumination devices 6, the fixture bodies 70A, 70B, and 70C holding the illumination device 6.

The lighting fixtures 7A, 7B, and 7C according to the embodiment include any of the above lighting devices 1, and accordingly have effects of enabling efficiency to be improved compared with a conventional lighting fixture.

The invention claimed is:

1. A lighting device, comprising a rectifier unit, a first current controller, a second current controller, a storage element, a charging current controller, a first rectifier element, a second rectifier element, a third rectifier element, and a fourth rectifier element, the rectifier unit being configured to rectify a sine wave AC voltage inputted between a pair of input terminals of the rectifier unit, and output a pulsating voltage from between a pair of output terminals of the rectifier unit, the first current controller including a first end that is electrically connected to a light source, and a second end that is electrically connected to the first rectifier element, the first current controller being electrically connected in series to the light source between the pair of output terminals via the first rectifier element, the first current controller being configured to control current flowing through the light source so that the current flowing through the light source does not exceed a first predefined value, the charging current controller being electrically connected in series to the storage element to constitute a series circuit with the storage element, the charging current controller being configured to control charging current flowing through the storage element, the series circuit including a first end that is electrically connected to the first end of the first current controller via the second rectifier element, and a second end that is electrically connected to the second end of the first current controller via the fourth rectifier element, the second rectifier element being configured to cause the charging current to flow through the storage element via the light source and not via the first current controller, the third rectifier element and the fourth rectifier element being electrically connected in series to the series circuit of the storage element and the charging current controller, the third rectifier element and the fourth rectifier element being configured so that a discharge current discharged from the storage element flows through the light source, the light source including a first light source and a second light source that are electrically connected in series to each other, the second current controller including a first end that is electrically connected to a connection point between the first light source and the second light source, and a second end that is electrically connected between the first rectifier element and a low-potential output terminal of the pair of output terminals, and the second current controller being configured to control current flowing through the first light source so that the current flowing through the first light source does not exceed a second predefined value.

2. The lighting device according to claim 1, wherein:

the second current controller includes a current detector that is electrically connected between the first rectifier element and the low-potential output terminal of the pair of output terminals and configured to detect a current through the first light source; and the second current controller is configured to control current through the first light source so that detection current by the current detector is identical with the second predefined value.

3. The lighting device according to claim 1, wherein the second current controller is configured to increase or decrease current flowing through the first light source according to pulsating voltage outputted from between the pair of output terminals.

4. An illumination device, comprising:

the lighting device according to claim 1; and the light source, each of the first light source and the second light source including one or more solid light emitting elements.

5. The illumination device according to claim 4, wherein the first light source is configured to have a forward voltage lower than the second light source.

6. A lighting fixture, comprising:

the illumination device according to claim 4; and a fixture body holding the illumination device.

7. The lighting device according to claim 2, wherein the second current controller is configured to increase and decrease current flowing through the first light source according to pulsating voltage outputted between the pair of output terminals.

8. An illumination device, comprising:

the lighting device according to claim 2; and the light source, each of the first light source and the second light source including one or more solid light emitting elements.

9. An illumination device, comprising:

the lighting device according to claim 3; and the light source, each of the first light source and the second light source including one or more solid light emitting elements.

10. An illumination device, comprising:

one or more light sources; and the lighting device according to claim 7; and the light source, each of the first light source and the second light source including one or more solid light emitting elements.

11. The illumination device according to claim 8, wherein the first light source is configured to have a forward voltage lower than the second light source.

12. The illumination device according to claim 9, wherein the first light source is configured to have a forward voltage lower than the second light source.

13. The illumination device according to claim 10, wherein the first light source is configured to have a forward voltage lower than the second light source.

14. A lighting fixture, comprising:

the illumination device according to claim 5; and a fixture body holding the illumination device.

15. A lighting fixture, comprising:

the illumination device according to claim 8; and a fixture body holding the illumination device.

16. A lighting fixture, comprising:

the illumination device according to claim 9; and a fixture body holding the illumination device.

17. A lighting fixture, comprising:
the illumination device according to claim 10; and
a fixture body holding the illumination device.

18. A lighting fixture, comprising:
the illumination device according to claim 11; and
a fixture body holding the illumination device.

19. A lighting fixture, comprising:
the illumination device according to claim 12; and
a fixture body holding the illumination device.

20. A lighting fixture, comprising:
the illumination device according to claim 13; and
a fixture body holding the illumination device.

* * * * *